US006026823A

United States Patent [19]

Gueret

[11] Patent Number: 6,026,823

[45] **Date of Patent: *Feb. 22, 2000**

[54] APPLICATOR FOR MAKE-UP OR A CARE PRODUCT

[75] Inventor: Jean-Louis H. Gueret, Paris, France

[73] Assignee: L'Oreal, Paris, France

[ * ] Notice: This patent issued on a continued prosecution application filed under 37 CFR 1.53(d), and is subject to the twenty year patent term provisions of 35 U.S.C. 154(a)(2).

[21] Appl. No.: 08/927,409

[22] Filed: Sep. 10, 1997

[30] Foreign Application Priority Data

Sep. 10, 1996 [FR] France ..... 96 11031

[51] Int. Cl.[7] ..... A45D 40/26

[52] U.S. Cl. ..... 132/218; 401/122; 401/129; 401/126

[58] Field of Search ..... 132/218, 73.5, 132/73, 74.5, 313, 317, 318, 320; 401/122, 129, 126; 15/144.1, 144.2

[56] References Cited

U.S. PATENT DOCUMENTS

| | | | |
|---|---|---|---|
| 1,715,387 | 6/1929 | Ralston | 401/126 |
| 2,173,959 | 9/1939 | Britt . | |
| 3,185,291 | 5/1965 | Lerner | 401/126 |
| 3,433,510 | 3/1969 | Hulterstrum | 15/144.1 |
| 4,165,755 | 8/1979 | Cassai . | |
| 4,370,989 | 2/1983 | Taylor . | |
| 4,396,028 | 8/1983 | Waggoner . | |
| 4,428,388 | 1/1984 | Cassai et al. . | |
| 5,071,277 | 12/1991 | Braun . | |
| 5,107,870 | 4/1992 | Beck et al. | 401/129 |
| 5,328,282 | 7/1994 | Charrier et al. | 401/126 |
| 5,435,328 | 7/1995 | Grohoske . | |

FOREIGN PATENT DOCUMENTS

| | | | |
|---|---|---|---|
| 1222251 | 6/1960 | France . | |
| 1395217 | 7/1965 | France . | |
| 2 701 196 | 8/1994 | France . | |
| 1459859 | 12/1976 | United Kingdom | 401/129 |

*Primary Examiner*—Todd E. Manahan
*Assistant Examiner*—Eduardo C. Robert
*Attorney, Agent, or Firm*—Oblon, Spivak, McClelland, Maier & Neustadt, P.C.

[57] ABSTRACT

Applicator, for make-up or a care product, including a reservoir capable of containing a product, a removable cap for closing the reservoir, the cap defining an axis, and a wand secured to the cap, this wand including first and second ends, an application member carried by the first end of the wand. This wand is secured to the cap via its second end. The fastening of the wand on the cap includes an articulation about a point which allows angular displacement of the wand relative to the axis of the cap, this angular displacement having a maximum amplitude which is less than or equal to 90°.

10 Claims, 3 Drawing Sheets

APPLICATOR FOR MAKE-UP OR A CARE PRODUCT

BACKGROUND OF THE INVENTION

1. Field of the Invention

The present invention relates to an applicator for make-up or a care product. An applicator of this type is for example used for applying an intensifying product, also known as mascara, to the eyelashes, or for applying eyeliner, eyeshadow, nail-care cream, nail varnish, lipstick or the like.

2. Discussion of the Background

A capillary applicator for make-up or a care product generally includes a reservoir containing the product to be applied and a removable cap which is for closing the reservoir. A wand is secured to the cap via one of its ends and, at its other end, it carries a member, such as a stiff brush or a fine brush, for applying the product. In the configuration in which the reservoir is closed by the cap, the application member is immersed in the reservoir. When the cap and the wand are removed from the reservoir, a certain quantity of product, which can then be applied, is picked up on the stiff brush or fine brush.

Customarily, the member for applying the product is assembled in line with the wand, which is itself in line with the cap. This rigid configuration sometimes makes the whole assembly difficult to manipulate. This is particularly so in that applying make-up to the corner of the eye and eyelid, or applying make-up to the left eye in the case of a right-handed person, or to the upper lip, requires the user to twist the wrist uncomfortably. Moreover, such manipulation under non-ergonomic conditions makes spillage and scraping more likely.

It has been noted that, upon opening make-up applicators, users describe a circular and non-linear movement with their hands. This natural gesture results in the wand carrying the application member emerging from the reservoir at a non-zero (acute) angle with respect to the axis of the reservoir. Such observations are described in FIG. 3A.

It is therefore noted that, as it passes through the wiping device, the application member is not wiped in an identical manner on all its faces. This is particularly critical in the case of application members which include convex contours, in which case wiping is naturally less effective.

Finally it is noted that, when it exits the reservoir, the application member is inclined and soils the rim of the reservoir.

Make-up applicators are already known in which the wand carrying the application member consists of two half-wands which are connected together by means of a hinge so as to reduce the distance between the cap and the application member. This has a number of drawbacks.

When, by actuation of the hinge, the half-wand which carries the application member is inclined relative to the half-wand carrying the cap, the distance between the user's hand which is holding the cap, and the application member, is shorter than when using a hingeless applicator. This results in a reduction in the range of the make-up gesture and contributes to the clumsiness of the maneuver.

Moreover, it is difficult to reinsert the wand into the reservoir when it is in a position which is inclined about its central hinge, the wand tending to give way under pressure.

Furthermore, when the reservoir includes a wiping member the hinge, positioned between the two half-wands, impedes the passage of the wand through the wiping member and product accumulates in the gaps in the hinge, giving rise to soiling. Moreover, a hinge of this type confers a certain fragility on the applicator assembly as a whole.

Finally, the manufacture of make-up applicators of small size which include a hinge midway along the wand cannot be envisaged on account of the bulk that a hinge of this type would necessarily represent. In fact, applicators of small size are much appreciated by users, since they are easy to carry and take up little space in a bag.

FR-A-2 701 196 discloses a make-up applicator comprising a reservoir, a removable cap for closing the reservoir, an application member carried by the end of a wand secured to the cap, and a grip articulated about an axis carried by the cap, this grip consisting of a small arch whose dimensions are such that in the folded position of the grip the small arch surrounds the reservoir.

An applicator of this type has the same drawbacks (reduction in the range of the make-up gesture, difficulties in inserting the wand into the reservoir) as those described hereinabove in the case of applicators including two half-wands which are connected together by means of a hinge.

U.S. Pat. No. 4,370,989 discloses a make-up applicator comprising a reservoir, a removable cap for closing the reservoir, and an application member carried by the end of a wand secured to the cap, the wand being connected to the cap by means of an articulation about an axis. An articulation of this type does not permit free orientation of the wand relative to the cap and does not allow homogeneous wiping of the application member. Also, with an applicator of this type, deposition of product on the rim of the reservoir is observed each time the applicator is used.

SUMMARY OF THE INVENTION

Surprisingly, the Applicant has overcome the drawbacks of the prior art by discovering a novel applicator for make-up or a care product, comprising: a reservoir capable of containing a product; a removable cap for closing the reservoir, the cap defining an axis; a wand including a first and a second end; and an application member carried by the first end of the wand, this wand being secured to the cap via its second end; characterized in that the fastening of the wand on the cap includes an articulation about a point which allows angular displacement of the wand relative to the axis of the cap in at least two planes where said at least two planes intersect and are parallel to said axis of said cap, this angular displacement having a maximum amplitude which is less than or equal to 90°.

This articulation is preferably located inside the cap.

Angular displacement of the wand relative to the cap may be limited by the edges of the cap or by a retention system inside the cap.

The articulation about a point may for example consist of a spherical ball-joint system. The articulation makes it possible to orient the wand relative to the cap in three dimensions, conferring greater flexibility and adaptability on the whole assembly. This articulation particularly enables the user to reach, more easily and without constraint, parts of the face to which it is difficult to apply make-up. It permits free orientation of the wand relative to the cap. In this way, the application member can emerge from the reservoir straight, it is thus wiped homogeneously and does not soil the rim of the reservoir. The edges of the cap and/or the ball-joint system limit the inclination of the wand relative to the cap. In this way, the user can exert considerable pressure on the device consisting of the application member, the wand and the cap, without the wand giving way under this pressure which is frequently observed in the case of the prior art devices which include two half-wands connected by a hinge or a wand and a grip articulated about an axis.

The distance between the user's hand and the application member is only slightly reduced by the inclination and therefore the make-up gesture can be as wide as with a non-articulated-wand device.

The wand may be reinserted into the reservoir without difficulty; it does not give rise to soiling through the wiping device and does not catch when passing through the wiping device. Each time the wand is reinserted into the reservoir, it is repositioned in the axis of the cap.

As the articulation is positioned between his or her fingers the manipulator or user exerts better control over this articulation.

The articulation is preferably equipped with at least one brake or retaining device.

Moreover, it is noted that an articulation of this type compensates for the circular opening movement of the applicator. In this way, the cap is inclined relative to the wand which remains straight as it emerges from the reservoir.

The application member may be of any type known to a person skilled in the art; for example it may be a stiff brush, a fine brush, an optionally flocked foam end piece, a spatula or a capillary rod.

BRIEF DESCRIPTION OF THE DRAWINGS

In order that the present invention may more readily be understood the following description is given, merely by way of example, with reference to the accompanying drawings, in which.

DESCRIPTION OF THE PREFERRED EMBODIMENTS

Figure 1:
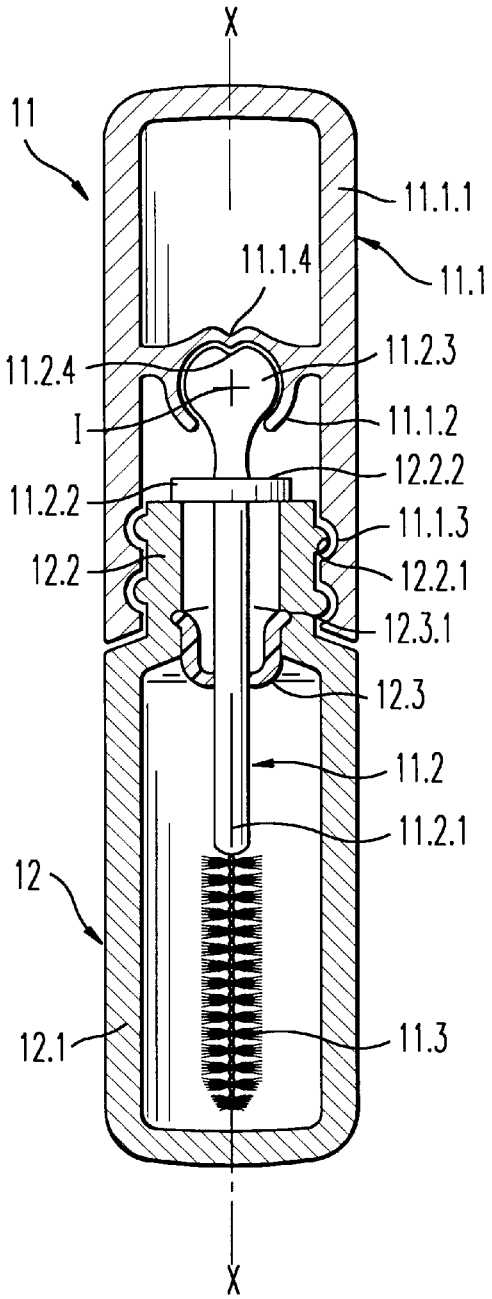
FIG. 1 shows, in longitudinal section in the closed position, a mascara applicator according to one form of the invention, equipped with a multidirectional ball joint.

The mascara applicator shown in FIG. 1 includes a reservoir 12, and an application device 11 comprising a cap 11.1, a wand 11.2 and a stiff brush 11.3.

In a known manner, the reservoir consists of a cylindrical body 12.1, but may have any other shape depending 20 on the product to be applied. It is surmounted by a neck 12.2 carrying a screw thread 12.2.1 and ending in a seat 12.2.2.

Inside the reservoir there is a wiping member 12.3 which is fastened to the neck 12.2 by means of a bead 12.3.1 which interacts with an annular groove in the neck.

A stiff brush 11.3 is fastened to a first end of the wand 11.2

The wand 11.2 can consists of a first end 11.2.1, of a sealing member 11.2.2 and of a substantially spherical ball joint 11.2.3 fastened at a second end of the wand 11.2 The ball joint includes a small circular cavity 11.2.4.

The sealing member 11.2.2 consists of an annular gasket in the shape of a disk which is traversed by the wand 11.2.1. The gasket is placed near to the ball joint 11.2.3.

Figure 4:
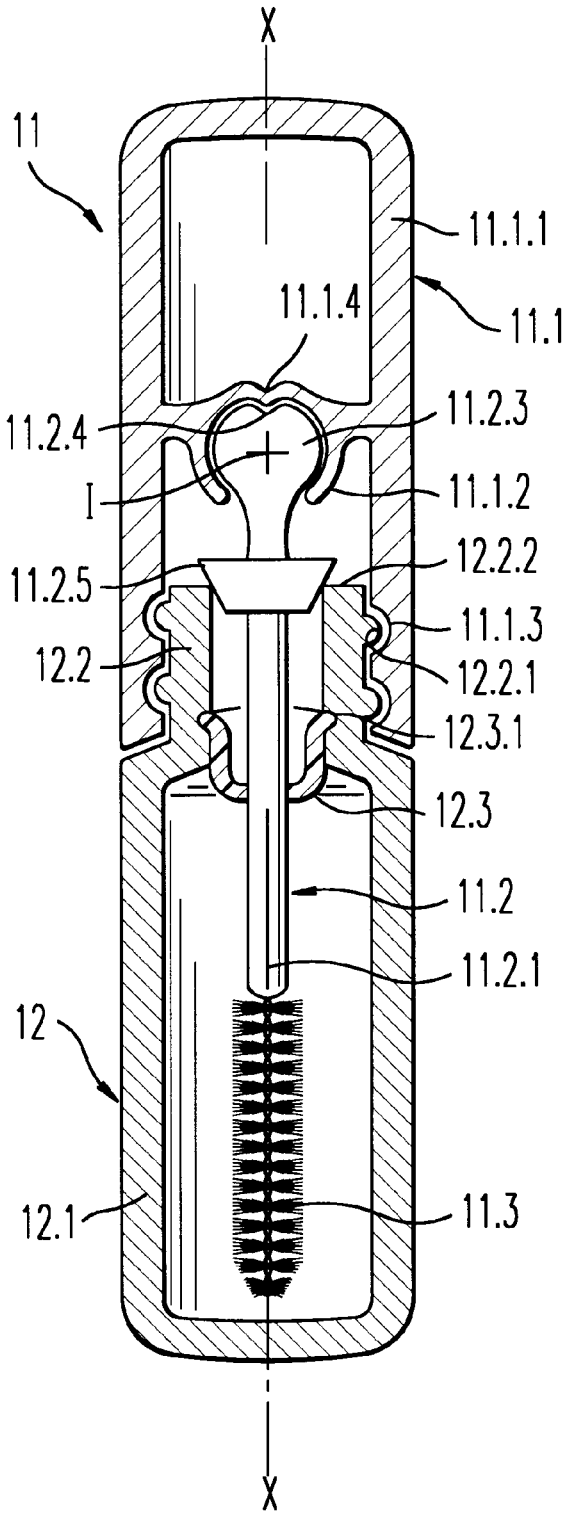
FIG. 4 is a longitudinal section of the mascara applicator of FIG. 1 where the sealing member takes the form of a cone shape.

In this Figure, the sealing member is a disk made from flexible material which is pressed against the free border of the seat 12.2.2 of the neck 12.2. However, the sealing member may consist of any other means known to a person skilled in the art, for example it may be a cone 11.2.5 made from deformable material slipped around the wand 11.2, as shown in FIG. 4

The sealing member may also be fastened on the cap 11.1 in a known manner.

The cap 11.1 consists of a cylindrical body 11.1.1 which includes a hollow housing 11.1.2, which is complementary to the ball joint 11.2.3, as well as a screw thread 11.1.3 complementary to a screw thread 12.2.1 of the neck 12.2 of the reservoir 12. The hollow housing 11.1.2 includes a retention member 11.1.4, complementary to the cavity 11.2.4.

The retention member 11.1.4 and the cavity 11.2.4 together form a retaining device so as to restrict the movement of the wand 11.2 about the articulation point I.

When the applicator is in the closed position, as shown in FIG. 1, the stiff brush 11.3, the wand 11.2 and the cap 11.1 are in line along a central axis X—X. The stiff brush 11.3 and that part of the wand 11.2 which adjoins it are located inside the reservoir. The gasket 11.2.2 rests against the free border of the seat 12.2.2 of the neck 12.2. The cap 11.1 is screwed in a leaktight manner onto the neck 12.2 of the reservoir 12.

When the application member 11.3 is removed from the reservoir, the stiff brush passes through the wiping device 12.3 and is ready to be used for making up the eyelashes, in the straight position or by making use of the tilting of the wand 11.2 about the ball joint 11.2.3.

Tilting of the ball joint is restricted by the retention member 11.1.4 which is housed in the cavity 11.2.4 in the configuration shown in FIG. 1.

Figure 2:
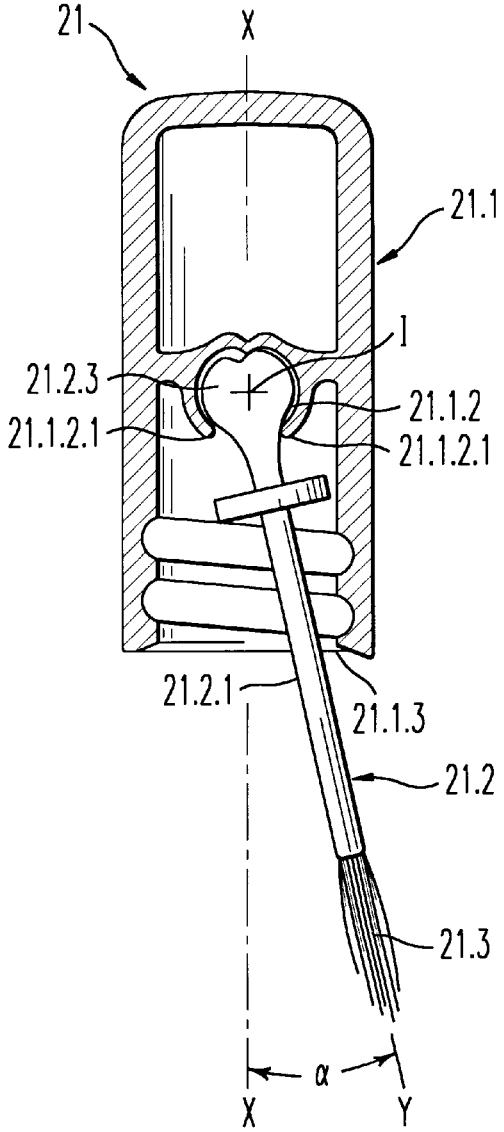
FIG. 2 shows, in longitudinal section in the inclined position, a nail-varnish applicator according to a variant of the invention equipped with a multidirectional ball joint, the reservoir of the make-up applicator has not been shown the applicator has been removed from its reservoir.

The application device 21 shown in FIG. 2 without its associated reservoir is distinguished from the device shown in FIG. 1 by the presence of a fine brush 21.3 instead of the stiff brush 11.3.

In this Figure, the ball joint 21.2.3 has been pivoted in the hollow housing 21.1.2 about its central point I, the wand 21.2.1 and the fine brush 21.3 being aligned along an axis Y—Y forming an angle $\alpha$ with respect to the central axis X—X of the cap.

The hollow housing 21.1.2 includes a circular edge 21.1.2.1 which limits the angular displacements of the wand 21.2.1.

This results in the angle $\alpha$ being limited to values which are preferably less than 20°, the amplitude of the angular displacement of the wand relative to the axis (X—X) consequently being limited to values which are less than or equal to 40°.

The angular displacement may also be limited by the edge 21.1.3 located at the opening of the cap 21.1, the articulation being located inside the cap.

This device is more particularly intended for applying a nail-varnish composition.

When the user uses the application device according to the invention, he/she may use it in the straight position (application member, wand and cap coaxially aligned) or in the inclined position. When he/she has caused the wand to tilt relative to the cap, a multitude of application possibilities are available by rotating the cap about its central axis.

So as to illustrate the characteristics of the opening movement, the representation of the application devices in FIGS. 2 and 3 has been limited to their essential elements.

Figure 3A:
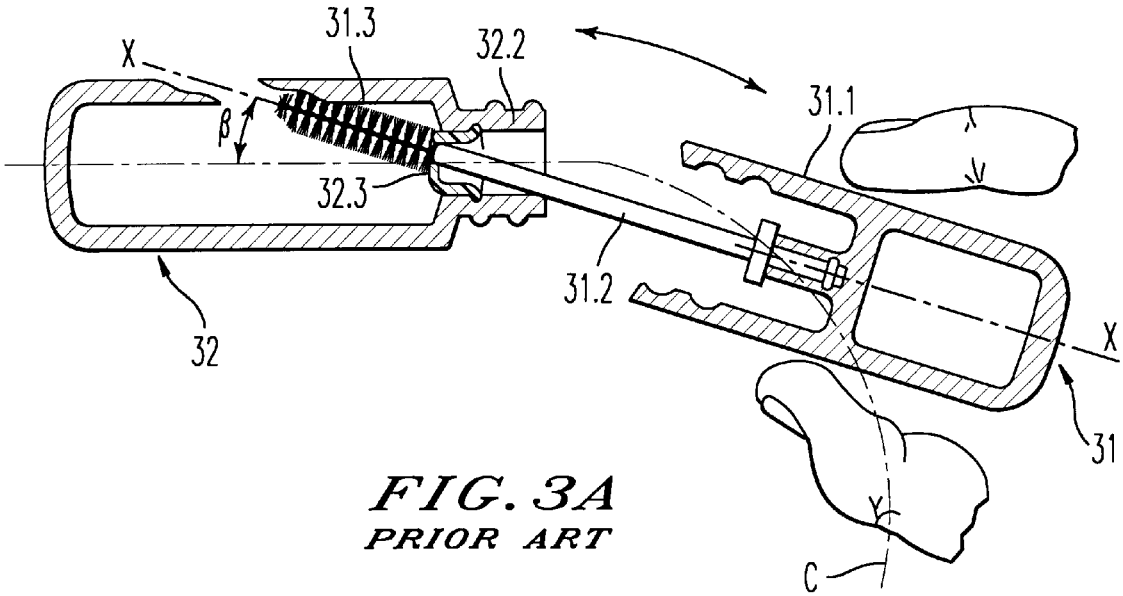
FIG. 3A PRIOR ART
FIGS. 3A and 3B show, in longitudinal section the opening of a make-up applicator according to the prior art and according to the invention, respectively.

FIG. 3A shows the opening of a make-up application device according to the prior art.

The make-up device includes a reservoir 32 which includes a wiping device 32.3 at the inner end of the neck 32.2, and an application device 31.

In his/her fingers, the user holds the cap 31.1 onto which a wand 31.2 has been sleeve-fastened via a first end. An application member, in this case a stiff brush, 31.3 is fastened at the second end of the wand. The cap, the wand and the application member are coaxially aligned on one and the same axis X—X.

When the user removes the application device 31 from the reservoir 32, it describes a circular movement with the cap, which is represented by the curve (C). It is noted that the application device and the reservoir form an angle β which varies during the movement. The stiff brush has a great deal of product wiped from it on one side and little or no product wiped from it on the other. It is also noted that it will rub against the rim 32.2 of the neck and thus soil it.

Figure 3B:
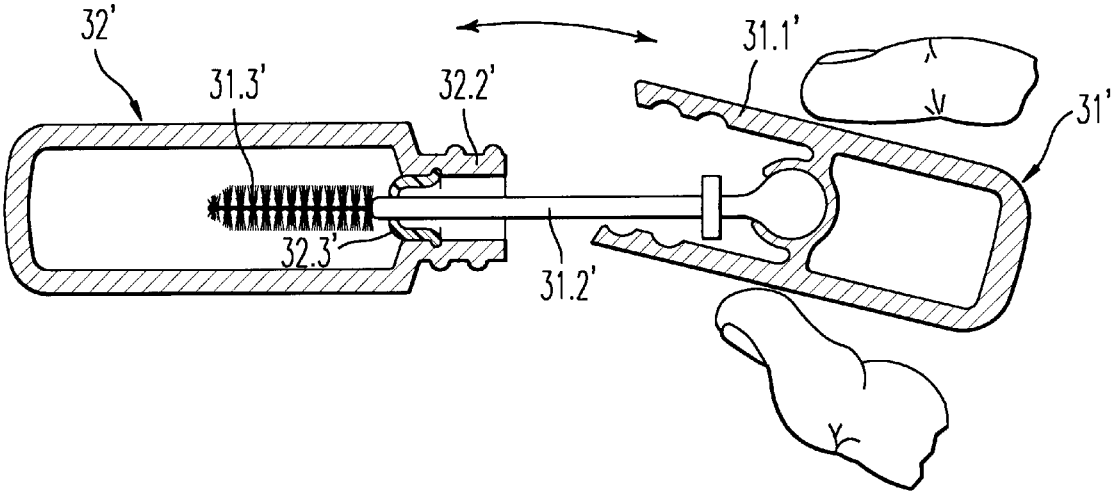

On the other hand, it will be noted that, on opening the device shown in FIG. 3B, the cap 31.1' pivots relative to the wand 31.2' and the stiff brush 31.3' but they remain aligned on the axis of the reservoir 32'. In this way, the stiff brush is wiped homogeneously by the wiping device 32.3' and it does not deposit soiling on the rim of the neck 32.2'.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. Applicator, for make-up or a care product, comprising:

a reservoir capable of containing the product;

a removable cap for closing the reservoir, the cap having an axis;

a wand including a first end and a second end, said second end of said wand being fastened to said cap at an articulation which allows angular displacement of the wand relative to the axis of the cap in at least two planes where said at least two planes intersect and are parallel to said axis of said cap, said angular displacement having a maximum amplitude which is less than or equal to 90°, said articulation including a retaining device which retricts the amplitude of the angular displacement than the maximum and freely allows lesser angular displacements; and an application member connected to the first end of the wand.

2. Applicator according to claim 1, wherein the articulation is located inside the cap.

3. Applicator according to claim 1, further comprising a wiping member connected to the reservoir.

4. Applicator according to claim 1, further comprising a sealing member connected to the wand.

5. Applicator according to claim 4, wherein the sealing member comprises an annular gasket in the shape of a disk.

6. Applicator according to claim 4, wherein the sealing member comprises a cone.

7. Applicator according to claim 1, wherein the amplitude of the angular displacement of the wand relative to the axis of the cap is limited to values less than or equal to 40°.

8. Applicator according to claim 1, wherein the application member is selected from the group consisting of a stiff brush, a fine brush, a foam end piece, a spatula and a capillary rod.

9. Applicator according to claim 1, wherein said articulation includes a spherical ball joint and a hollow housing complimentary to the ball joint.

10. Applicator according to claim 9, the spherical ball joint is fastened at the second end of the wand and is located in the cap, and said retaining device includes a circular cavity located in the spherical ball joint and a retention member, which compliments the cavity, located in the hollow housing.

* * * * *

UNITED STATES PATENT AND TRADEMARK OFFICE

CERTIFICATE OF CORRECTION

PATENT NO. : 6,026,823

DATED : Feb. 22, 2000

INVENTOR(S): Jean-Louis H. GUERET

It is certified that an error appears in the above-identified patent and that said Letters Patent is hereby corrected as shown below:

Column 3, line 42, delete "and"

Column 3, line 57, delete "20"

Column 4, line 2, change "11.2.1" to --11.2--

Column 6, line 10, delete "than the maximum";

line 11, after "displacements" insert --than the maximum amplitude--.

Signed and Sealed this

Thirteenth Day of February, 2001

*Attest:*

Nicholas P. Godici

NICHOLAS P. GODICI

*Attesting Officer*

*Acting Director of the United States Patent and Trademark Office*